US007980779B2

(12) United States Patent
Barausky et al.

(10) Patent No.: US 7,980,779 B2
(45) **Date of Patent: *Jul. 19, 2011**

(54) ADJUSTABLE TAB DIVIDER

(75) Inventors: Sasha Barausky, Boston, MA (US); Ryan Shafer, Uxbridge, MA (US); Irene Wong, Malden, MA (US); Tom Lutzow, Providence, RI (US); Matthew Chace Carpenter, North Attleboro, MA (US)

(73) Assignee: Staples The Office Superstore, LLC, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/768,978

(22) Filed: Apr. 28, 2010

(65) Prior Publication Data

US 2010/0209177 A1 Aug. 19, 2010

Related U.S. Application Data

(63) Continuation of application No. 12/268,500, filed on Nov. 11, 2008, now Pat. No. 7,731,442.

(51) Int. Cl.
*B41J 3/407* (2006.01)

(52) U.S. Cl. ..... 402/79; 40/641; 206/425

(58) Field of Classification Search ..... 283/36–43; 281/42, 45, 2, 3.1, 5; 402/70, 73, 79; 229/67.1–67.3; 383/64; 40/359, 360, 641; 116/321–324

See application file for complete search history.

(56) References Cited

U.S. PATENT DOCUMENTS

| | | | |
|---|---|---|---|
| 795,609 | A | 7/1905 | Hendrickson |
| 1,705,753 | A | 3/1929 | Dawson |
| 1,741,066 | A | 12/1929 | Morgan |
| 1,899,382 | A | 2/1933 | Berry |
| 1,975,662 | A | 10/1934 | Rand |
| 2,122,223 | A | 6/1938 | Von Dollen |
| 2,969,793 | A | 1/1961 | Burrer |
| 3,204,639 | A | 9/1965 | Kleffman |

(Continued)

FOREIGN PATENT DOCUMENTS

BE 560 471 9/1957

(Continued)

OTHER PUBLICATIONS

International Search Report and Written Opinion from corresponding PCT application No. US2009/005911 dated Mar. 1, 2010.

*Primary Examiner* — Dana Ross
*Assistant Examiner* — Matthew G Katcoff
(74) *Attorney, Agent, or Firm* — Wolf, Greenfield & Sacks, P.C.

(57) ABSTRACT

Embodiments of the invention relate to dividers with tabs adjustable along at least two edges of the binder. One embodiment is directed to a divider for use in a binder. The divider comprises a panel, the panel comprising a binding edge and a plurality of non-binding edges, and a tab. The panel comprises at least one binding feature adjacent the binding edge and at least one tab mating feature adjacent at least first and second edges of the plurality of non-binding edges. The tab is configured to mate with the at least one tab mating feature. The at least one tab mating feature is configured such that the tab is positionable in at least two longitudinal positions along the first non-binding edge and in at least two longitudinal positions along the second non-binding edge.

20 Claims, 9 Drawing Sheets

U.S. PATENT DOCUMENTS

| | | | |
|---|---|---|---|
| 3,590,511 | A | 7/1971 | Heimann |
| 4,400,107 | A | 8/1983 | Pitts |
| 4,445,711 | A | 5/1984 | Cunningham |
| D275,576 | S | 9/1984 | Kirk |
| 4,905,393 | A | 3/1990 | Laurie |
| 5,135,261 | A | 8/1992 | Cusack et al. |
| 5,226,734 | A | 7/1993 | Scott et al. |
| 5,503,487 | A | 4/1996 | Ong |
| 5,540,513 | A | 7/1996 | Wyant |
| 5,707,001 | A | 1/1998 | Mark et al. |
| 5,875,579 | A | 3/1999 | Winzen |
| 5,909,979 | A | 6/1999 | Winzen |
| 5,953,843 | A | 9/1999 | Collins et al. |
| D416,939 | S | 11/1999 | Marsy |
| 5,996,881 | A | 12/1999 | Smith |
| D421,050 | S | 2/2000 | Henrikson et al. |
| 6,042,291 | A | 3/2000 | Ho |
| D443,895 | S | 6/2001 | Pfanner et al. |
| 6,273,630 | B1 | 8/2001 | Sgro et al. |
| 6,361,639 | B1 | 3/2002 | Owen et al. |
| 6,409,409 | B2 | 6/2002 | Bauman et al. |
| D478,124 | S | 8/2003 | Yamamoto et al. |
| 6,632,042 | B1 | 10/2003 | Liener Chin et al. |
| 6,732,461 | B2 | 5/2004 | Slattery et al. |
| 6,736,428 | B1 | 5/2004 | Insalaco |
| 6,752,559 | B2 | 6/2004 | Sapienza et al. |
| 6,851,718 | B2 | 2/2005 | Liener Chin et al. |
| D522,575 | S | 6/2006 | Smith |
| D522,576 | S | 6/2006 | Smith |
| 7,125,050 | B2 | 10/2006 | Yamamoto et al. |
| 7,140,644 | B2 | 11/2006 | Hanes |
| 7,240,443 | B2 | 7/2007 | Nathanson et al. |
| 7,334,363 | B1 | 2/2008 | Hansen |
| D567,286 | S | 4/2008 | Takahashi |
| 7,383,652 | B2 | 6/2008 | Glasberg |
| 7,389,598 | B2 | 6/2008 | Bunger et al. |
| D601,624 | S | 10/2009 | Barausky et al. |
| D602,524 | S | 10/2009 | Wong et al. |
| 2003/0126779 | A1 | 7/2003 | Sato et al. |
| 2005/0093290 | A1 | 5/2005 | Richied |
| 2006/0076771 | A1 | 4/2006 | Schafer |
| 2006/0225322 | A1 | 10/2006 | O'Leary et al. |
| 2007/0019053 | A1 | 1/2007 | Sato et al. |
| 2007/0031180 | A1 | 2/2007 | Grogan |
| 2007/0234601 | A1 | 10/2007 | Yoo et al. |

FOREIGN PATENT DOCUMENTS

| | | |
|---|---|---|
| DE | 855 393 | 7/1949 |
| DE | 1 093 331 | 11/1960 |

ADJUSTABLE TAB DIVIDER

RELATED APPLICATIONS

This application is a continuation application of and claims the benefit under 35 U.S.C. §120 of U.S. application Ser. No. 12/268,500, entitled "Adjustable Tab Divider," filed on Nov. 11, 2008, which is herein incorporated by reference in its entirety.

FIELD OF THE INVENTION

The invention is generally directed to dividers for three-ring binders and the like, and more particularly to dividers having adjustable tabs.

BACKGROUND OF THE INVENTION

Various techniques have been used to divide a stack of paper, such as a stack of paper held by a binder, into different sections. One conventional technique involves using divider pages having integrally formed tabs at fixed locations. Such divider pages are generally sold in sets with the tabs of the divider pages in a set being formed at different longitudinal locations along the edge of the divider page opposite the edge at which the dividers are bound. In a binder, the divider pages are arranged so that each tab is visible (i.e., not obstructed by another tab). Further, dividers are generally arranged so that the first divider in a series has a tab located at one end of the divider edge, and each successive divider in the series has a tab offset by some increment.

The fixed location of the tabs of such dividers leads to disadvantages. For example, the insertion, removal, and rearrangement of divider pages having integrally formed tabs may disrupt the orderly progression of the tabs in a binder, resulting in the obstruction of some tabs by other tabs and a generally disorganized appearance.

To address the disadvantages that result from using fixed tabs, dividers with repositionable tabs have been developed. One divider having a repositionable tab is described in U.S. Pat. No. 5,503,487 ("Ong"). The divider of Ong is rectangular in shape and includes an edge with holes to receive binder rings and an opposite edge having a plurality of parallel, uniformly spaced slots. The divider includes a tab, which may be provided with a label. The tab may be positioned between any two neighboring slots by inserting ears of the tab into the neighboring slots. The tab may be removed and repositioned by removing the ears from one pair of neighboring slots and introducing the ears into a different pair having a different longitudinal location. U.S. Publication No. 2003/0126779 ("Sato et al.") describes another type of repositionable-tab divider. In particular, Sato et al. describes a divider having a rail along which a tab is movable. Thus, the tab may be repositioned by sliding the tab along the rail.

While being able to reposition a tab on a divider overcomes some of the drawbacks associated with divider pages having integrally formed tabs, existing dividers still suffer from limitations. Accordingly, an improved divider design is needed.

SUMMARY OF THE INVENTION

One embodiment of the invention is directed to a divider for use in a binder. The divider comprises a panel, the panel comprising a binding edge and a plurality of non-binding edges, and a tab. The panel comprises at least one binding feature adjacent the binding edge and at least one tab mating feature adjacent at least first and second edges of the plurality of non-binding edges. The tab is configured to mate with the at least one tab mating feature. The at least one tab mating feature is configured such that the tab is positionable in at least two longitudinal positions along the first non-binding edge and in at least two longitudinal positions along the second non-binding edge.

Another embodiment of the invention is directed to a method of adjusting a tab on a divider, the divider comprising a panel having a binding edge and a plurality of non-binding edges. The method comprises moving the tab from a first position along a first non-binding edge to a second position along a second non-binding edge, and providing the tab with information identifying content demarcated by the tab.

A further embodiment is directed to a divider for use in a binder, the divider comprising a panel comprising a binding edge and a plurality of non-binding edges. The panel comprises a plurality of holes to receive binder rings adjacent the binding edge and a track adjacent first and second non-binding edges of the plurality of non-binding edges, wherein the track comprises a first track portion adjacent the first non-binding edge, a second track portion adjacent the second non-binding edge and oriented perpendicular to the first track portion, and a corner track portion adjoining the first and second track portions. The divider further comprises a tab comprising a track-mating portion configured to couple the tab to the track in a manner such that the tab is slidable along the track from the first track portion to the second track portion via the corner track portion.

DETAILED DESCRIPTION OF THE INVENTION

While being able to reposition a tab on a divider overcomes some of the drawbacks associated with divider pages having integrally formed tabs, existing dividers still suffer from limitations. One drawback associated with existing dividers is when more than a relatively small number of tabs is used, some tabs will necessarily be obstructed by others. Further, no flexibility is provided with respect to which side of the binder the tabs are positioned on. The tabs, though movable, are restricted to a location along one edge.

In view of the deficiencies associated with conventional dividers, there is a need for improved dividers. In particular, it is desirable to provide a divider that has a greater number of non-overlapping positions in which the tab may be positioned, to increase the number of dividers that may be used in a binder without substantial overlap of the tabs. In addition, it is desirable to provide a divider having flexibility with respect to the edge along which a tab is positioned. The dividers of embodiments described below may advantageously exhibit these features according to some implementations.

Figure 1:
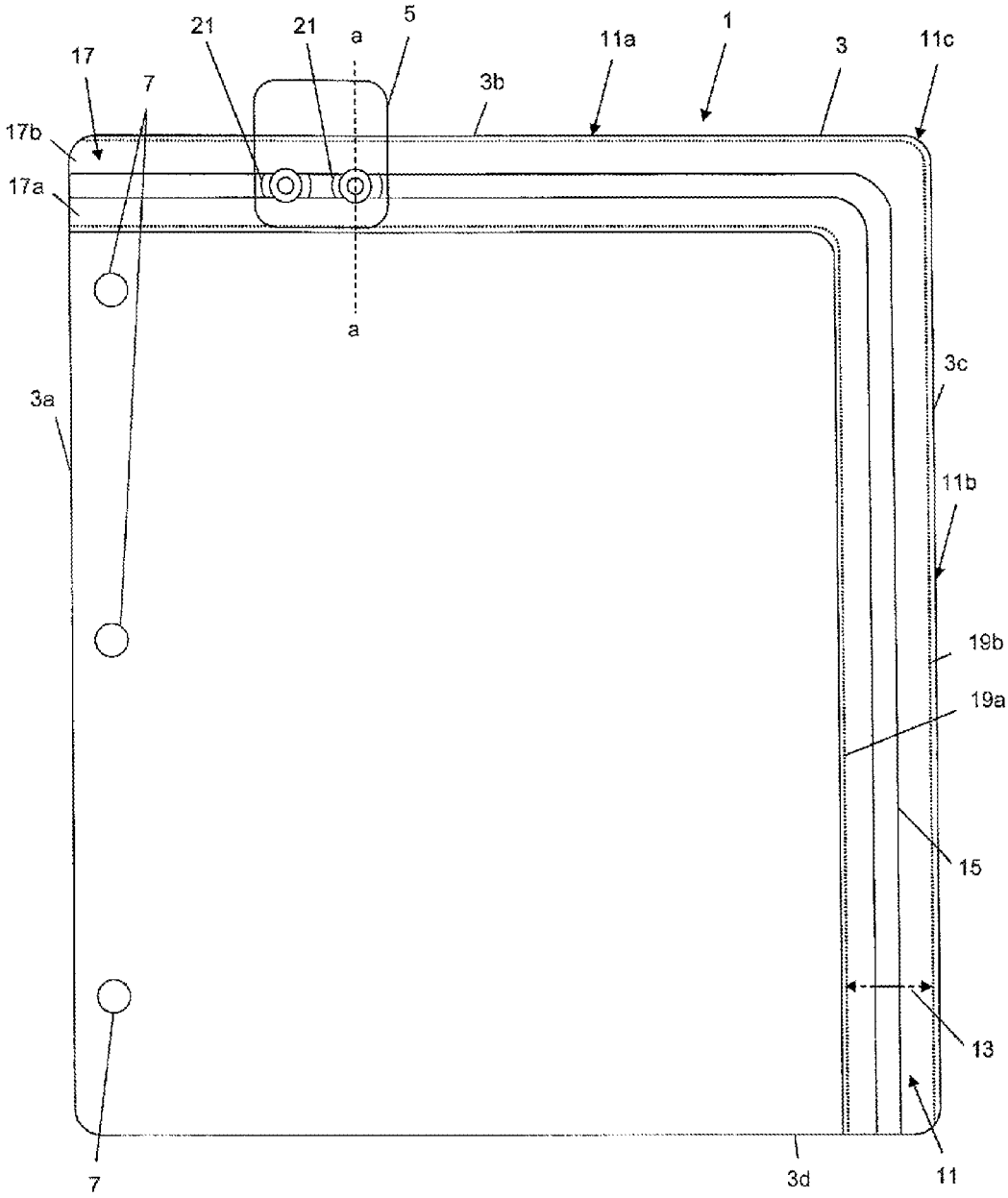
FIG. 1 shows a front view of a divider having a slidable tab.

FIGS. 1-4 illustrate one embodiment of a divider having a repositionable tab. The divider may be used to divide sections of paper, such as sections of loose leaf paper held by a binder. As shown in FIG. 1, the divider 1 includes a panel 3 and a tab 5. According to one exemplary implementation, the panel 3 may be sized to approximate the size of loose leaf paper. For example, the divider may be approximately 8.5 inches wide and approximately 11 inches long. The panel 3 comprises a binding edge 3*a* and three non-binding or free edges 3*b*, 3*c* and 3*d*. Adjacent the binding edge 3*a*, the panel comprises three holes 7, which are sized and positioned to each receive a ring of a three-ring binder. For example, the holes 7 may have a spacing of approximately 4.25 inches and may each have a diameter of approximately 0.25 inches. Other numbers of holes, spacing of the holes, and shapes and dimensions of the holes are possible.

The panel 3 comprises a track 11 along which the tab 5 is movable. In the exemplary embodiment of FIGS. 1-4, the track 11 extends along two non-binding edges. In particular, the track 11 comprises a first track portion 11*a* adjacent non-binding edge 3*b*, a second track portion 11*b* adjacent non-binding edge 3*c* and oriented perpendicular to the first track portion, and a corner track portion 11*c* adjoining the first and second track portions. Alternatively, however, the track 11 may include track portions adjacent non-binding edges 3*c* and 3*d* with a corner track portion adjoining the two, or track portions adjacent non-binding edges 3*b*, 3*c* and 3*d* with corner track portions adjoining the adjacent track portions.

In the embodiment of FIGS. 1-4, the track 11 comprises a slot 13 having a opening 15. The opening 15 is defined by a first side 17*a* and second side 17*b* of a slot covering 17. In an exemplary implementation, both the panel 3 and the slot covering 17 are formed of a thermoplastic polymer or other material. For example, the panel 3 and the slot covering 17 may be formed of polypropylene. In the exemplary embodiment of FIGS. 1-4, the slot covering 17 is coupled to the panel 3 with heat welds 19*a* and 19*b* respectively associated with the first side 17*a* and second side 17*b* of a slot covering 17. The panel 3 and slot covering 17 are melted together along the heat welds 19*a* and 19*b*.

The tab 5 is slidable along the track 11. The tab 5 comprises disks 21 that are received within the slot 13 to form a mating connection. The disks 21 are slidable within the slot 13 along the first track portion 11*a*, second track portion 11*b*, and corner track portion 11*c*. To facilitate sliding the disks 21 about corner track portion 11*c*, the corner track portion may be curved, as shown in FIG. 1.

Figure 2:
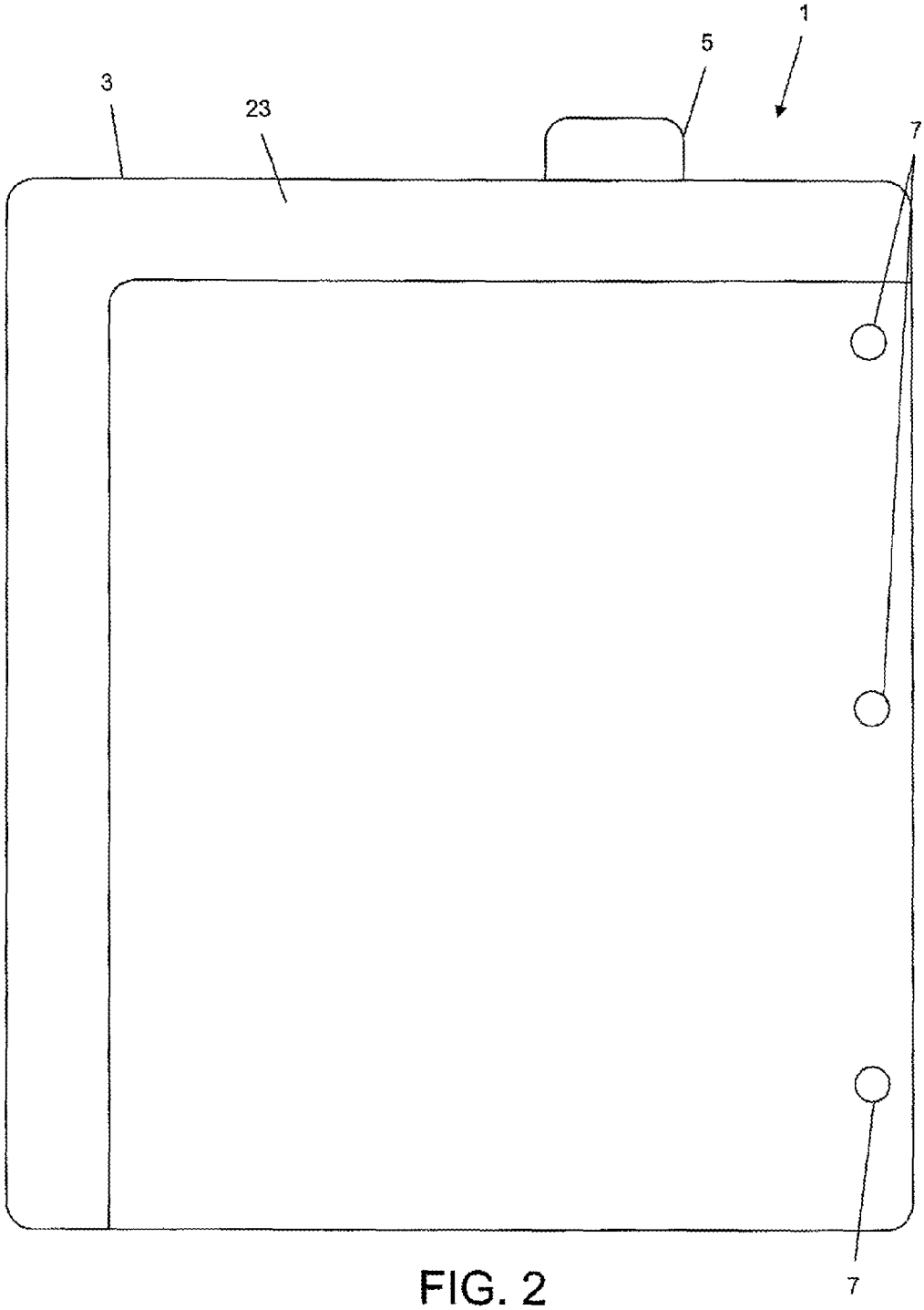
FIG. 2 shows a rear view of the divider shown in FIG. 1.

FIG. 2 shows a rear view of the divider 1. As shown, the rear side of the panel 3 includes a reinforcement panel portion 23 that may be optionally coupled adjacent the rear side of the track 11. The reinforcement panel portion 23 may be used to reinforce the track 11 and/or provide greater stiffness. The reinforcement panel portion 23 may be coupled to the panel 3 with an adhesive, heat weld, or other attachment means. Further, the reinforcement panel portion 23 may be separately or integrally formed with panel 3.

Figure 3:
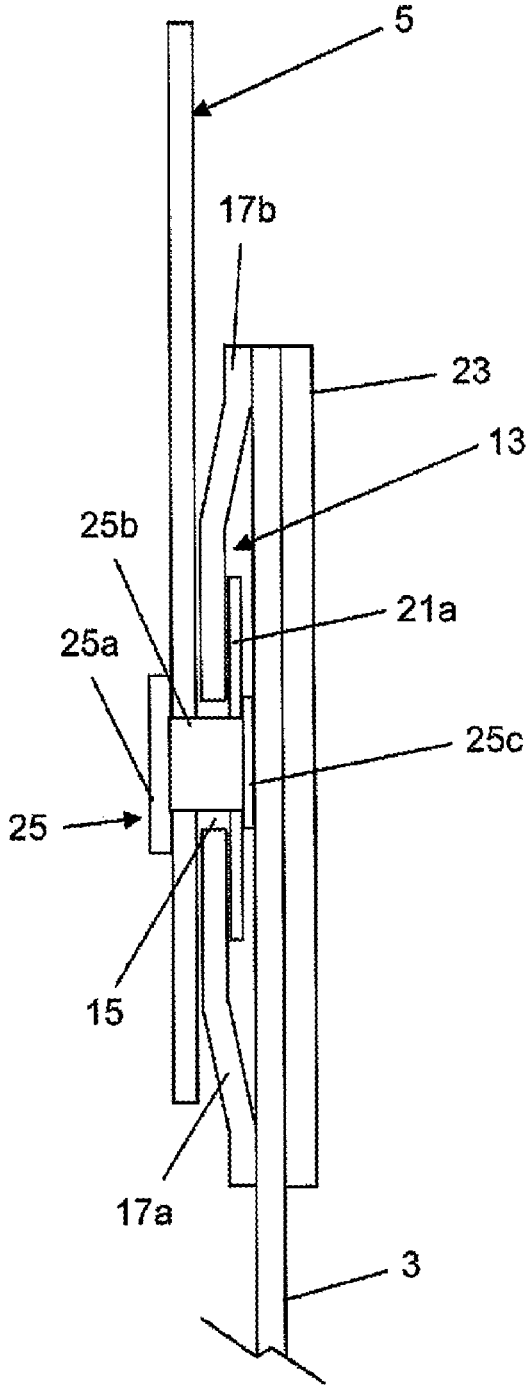
FIG. 3 shows a cross-sectional view of the mating interface between the tab and the track of the divider shown in FIG. 1, taken across line a-a in FIG. 1.

FIG. 3 shows a cross-sectional view of the mating interface between the tab 5 and the track 11, taken across line a-a in FIG. 1. The disks 21 are coupled to the tab 5 via fasteners 25, which may comprise eyelets, rivets, brads, or other fastening means. The fasteners 25 each comprise a head 25*a*, a post 25*b* and a base 25*c*. The head 25*a* of the fastener 25 is located exterior to the slot 13 and is coupled to the post 25*b*. The post 25*b* of the fastener passes through the tab 5 and the slot opening 15. The base 25*c* of the fastener 25, which is also coupled to the post 25*b*, is located interior to the slot 13, between the disk 21 and the panel 3. The post 25*b* has a smaller diameter than the slot opening 15 and is movable along the slot opening. The disk 21 slides within the slot 13 and has a sufficiently larger diameter than the slot opening 15 to prevent the tab 5 from detaching from the track 11.

Figure 4:
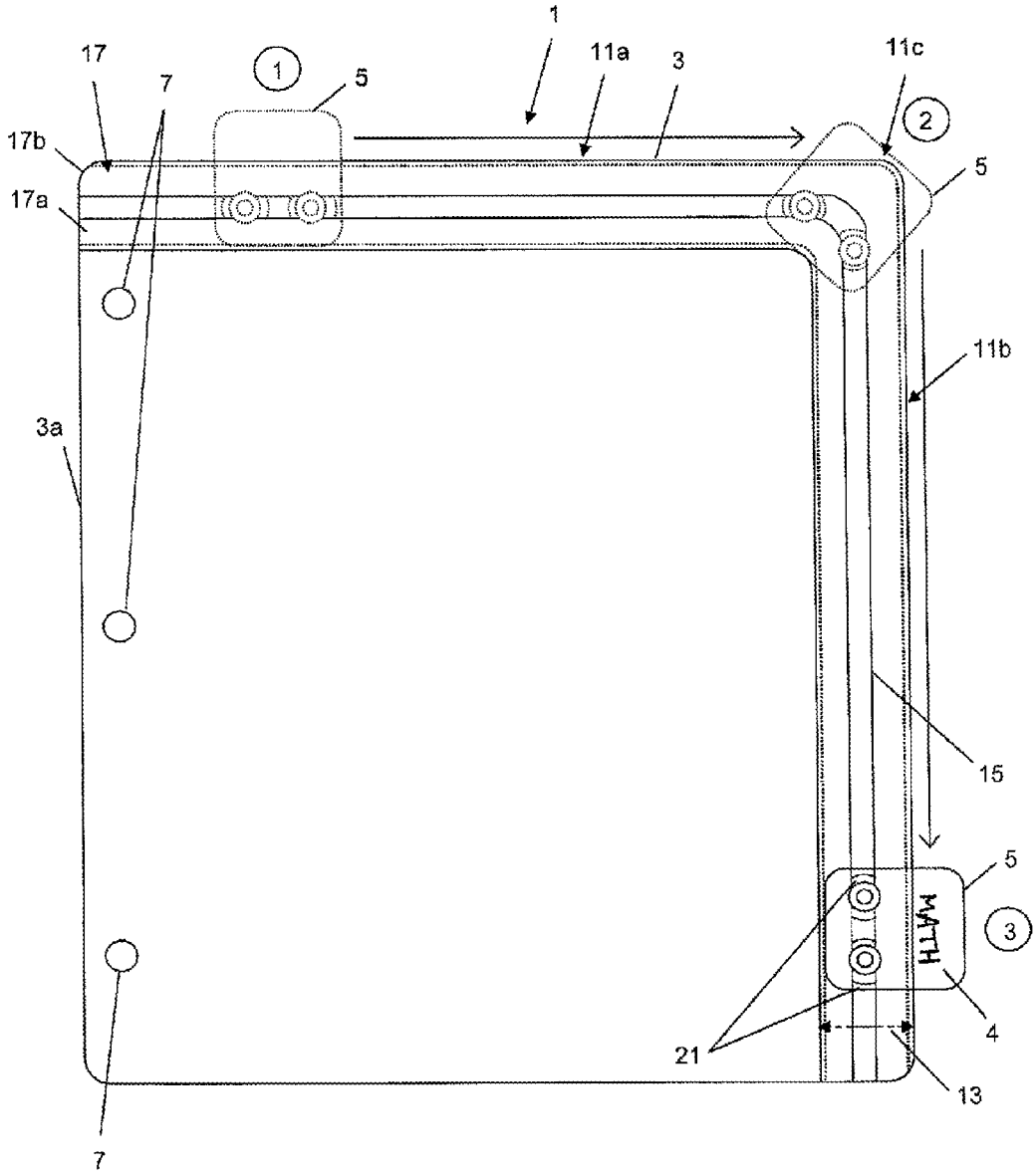
FIG. 4 shows a method of adjusting the tab of the divider shown in FIG. 1.

FIG. 4 illustrates a method of adjusting the position of the tab 5 on the panel 3. As shown, the tab 5 may be slid about a corner from an initial position along a first track portion having a first longitudinal axis to a final position along a second track portion having a second longitudinal axis perpendicular to the first longitudinal axis. In position (1), the tab 5 is positioned along the first track portion 11*a*. By grasping the tab 5 and sliding the disks 21 longitudinally within the slot 13, the tab 5 may be moved to position (2) at the corner track portion 11*c*. By sliding the tab 5 a further distance, the tab 5 may be moved to position (3) along the second track portion 11*b*. The transition between positions (1) and (3) may be performed by sliding the tab 5 continuously or incrementally.

The tabs described herein may be provided with information identifying a portion of the contents of the binder that is demarcated by the tab. The information may be written, typed, or printed on the tab. Alternatively, information may be written, typed, or printed on a label or insert associated with the tab. In FIG. 4, information 4 identifying a section in a binder is handwritten on a front surface of the tab 5.

Figure 8:
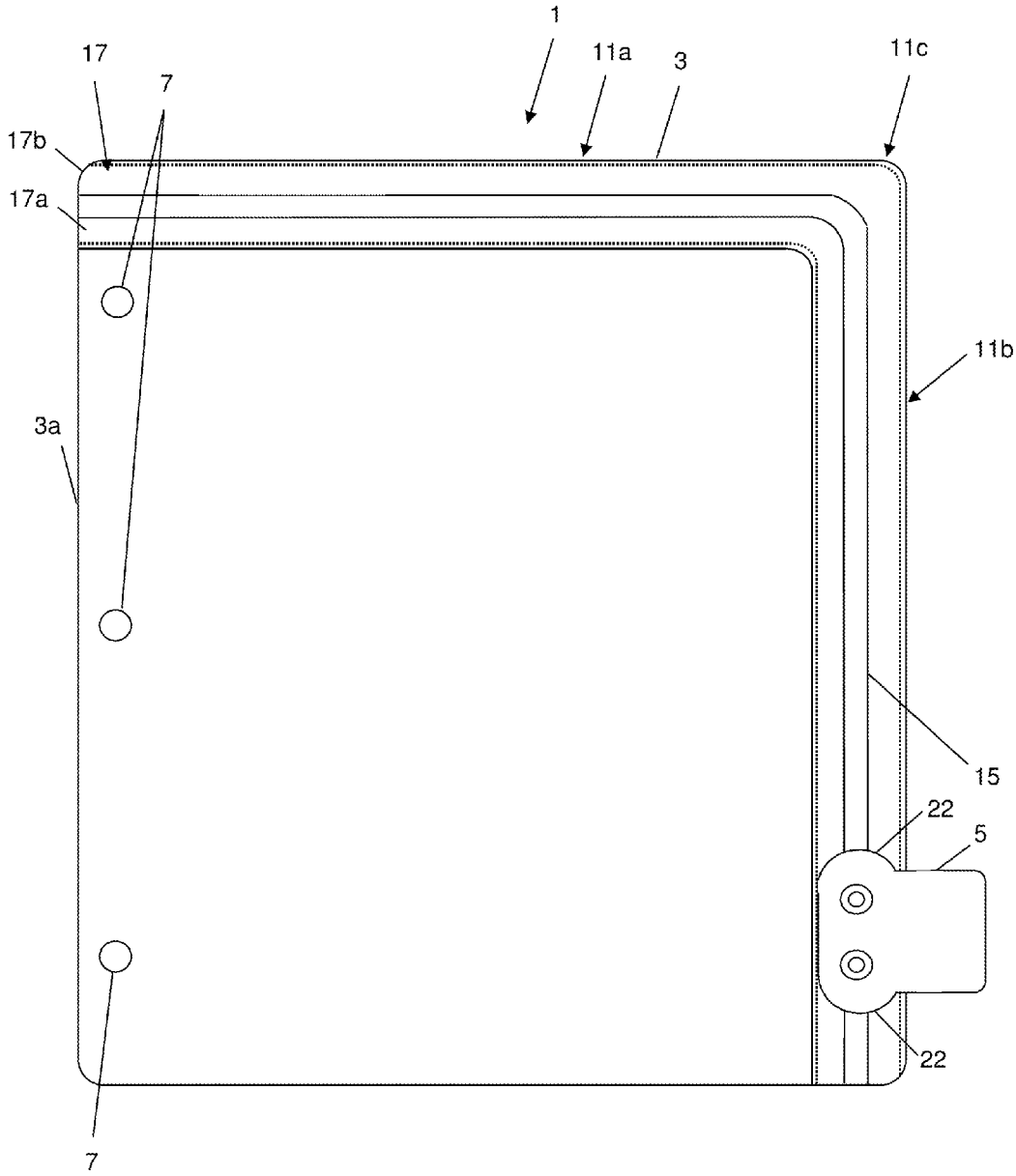
FIG. 8 shows a front view of a divider having a slidable tab.
Figure 9:
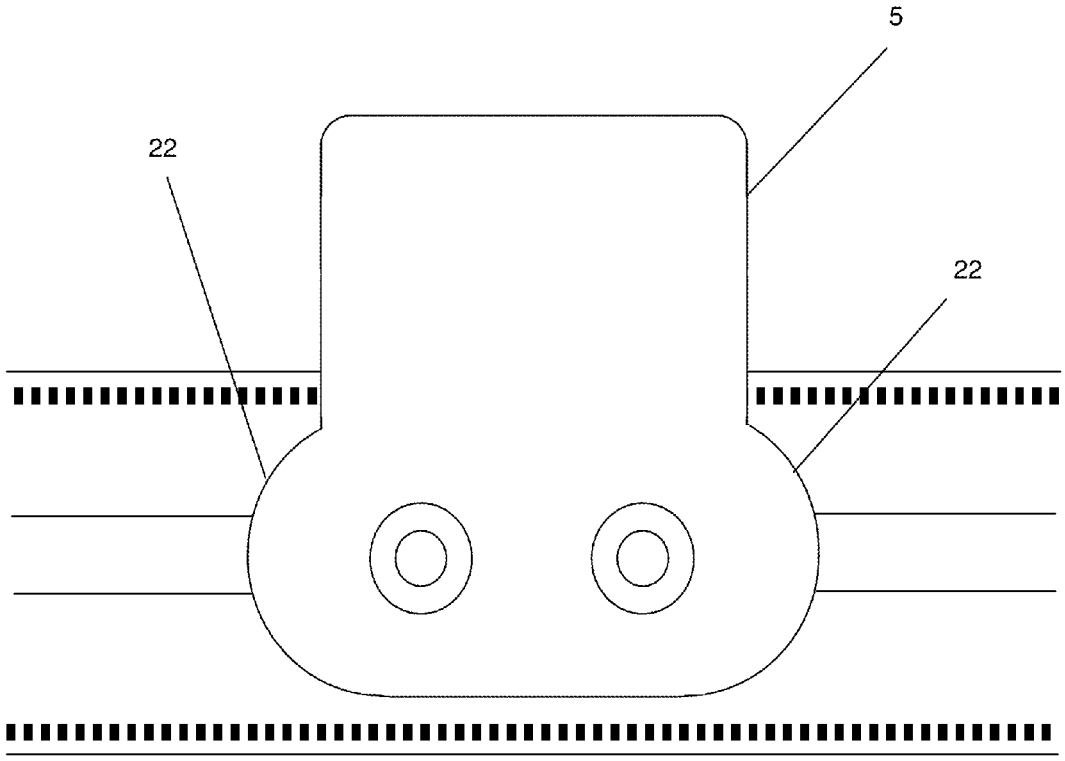
FIG. 9 shows the slidable tab shown in FIG. 8.

It should be appreciated that the size and shape of the tab 5 may vary according to different embodiments of the present invention. In the embodiment illustrated in FIG. 1, the tab 5 is substantially rectangular shaped. In another embodiment shown in FIGS. 8 and 9, the tab 5 has a wing-shaped portion 22 that wraps around the disks 21. In this embodiment, the outer shape of a portion of the tab 5 may substantially follow the circular contour of the disks 21.

Although the track 11 of FIGS. 1-4 comprises slot 13 having an opening 15, many alternative implementations for the track are possible. For example, the track 11 may comprise a rail to which the tab 5 is slidably coupled. For example, a tab mating feature may wrap partially or wholly around the rail, and may be slidable along the rail. The rail may comprise, for example, a strip of polypropylene.

Figure 5:
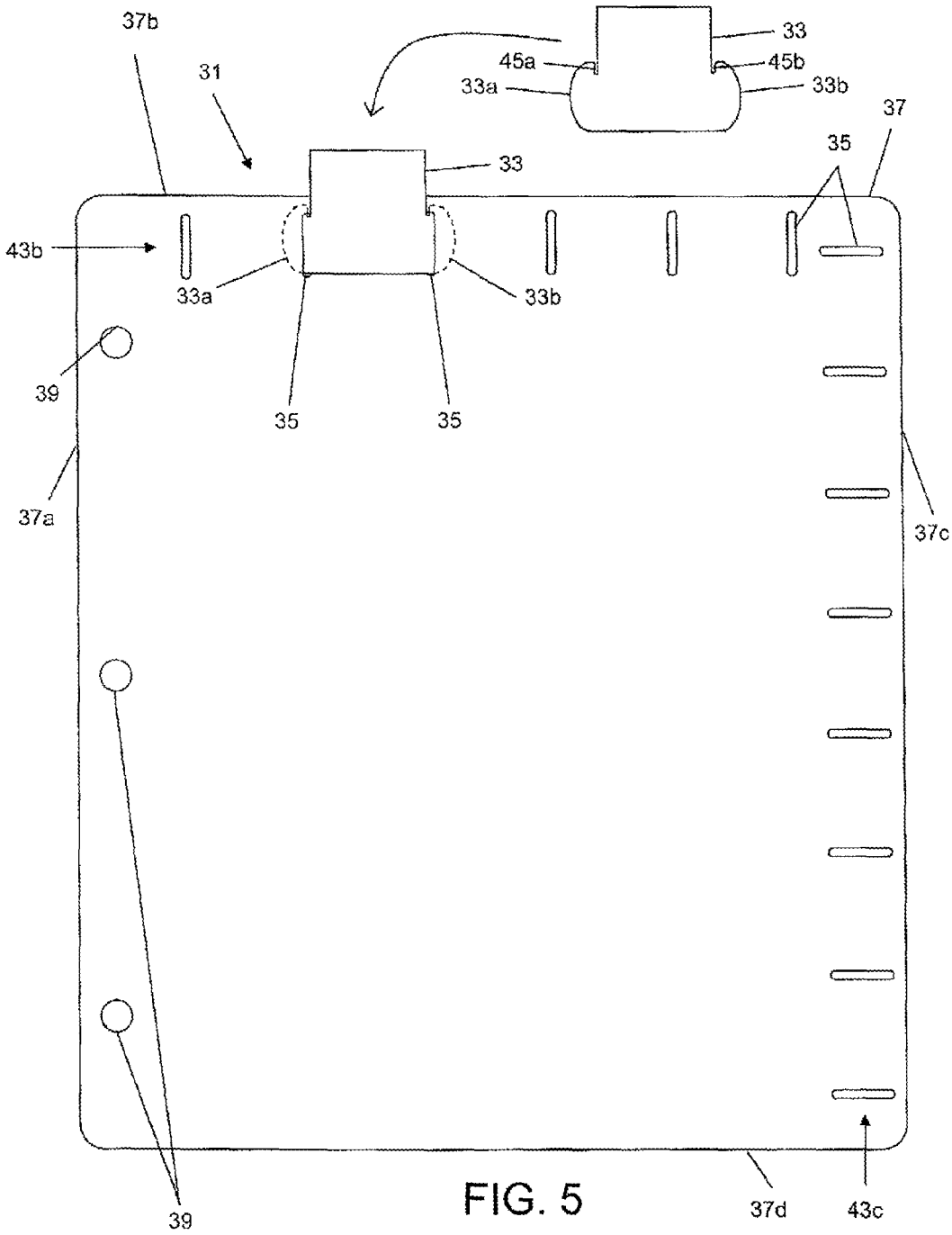
FIG. 5 shows a front view of a divider having a removable tab positioned along a top edge of the divider.
Figure 6:
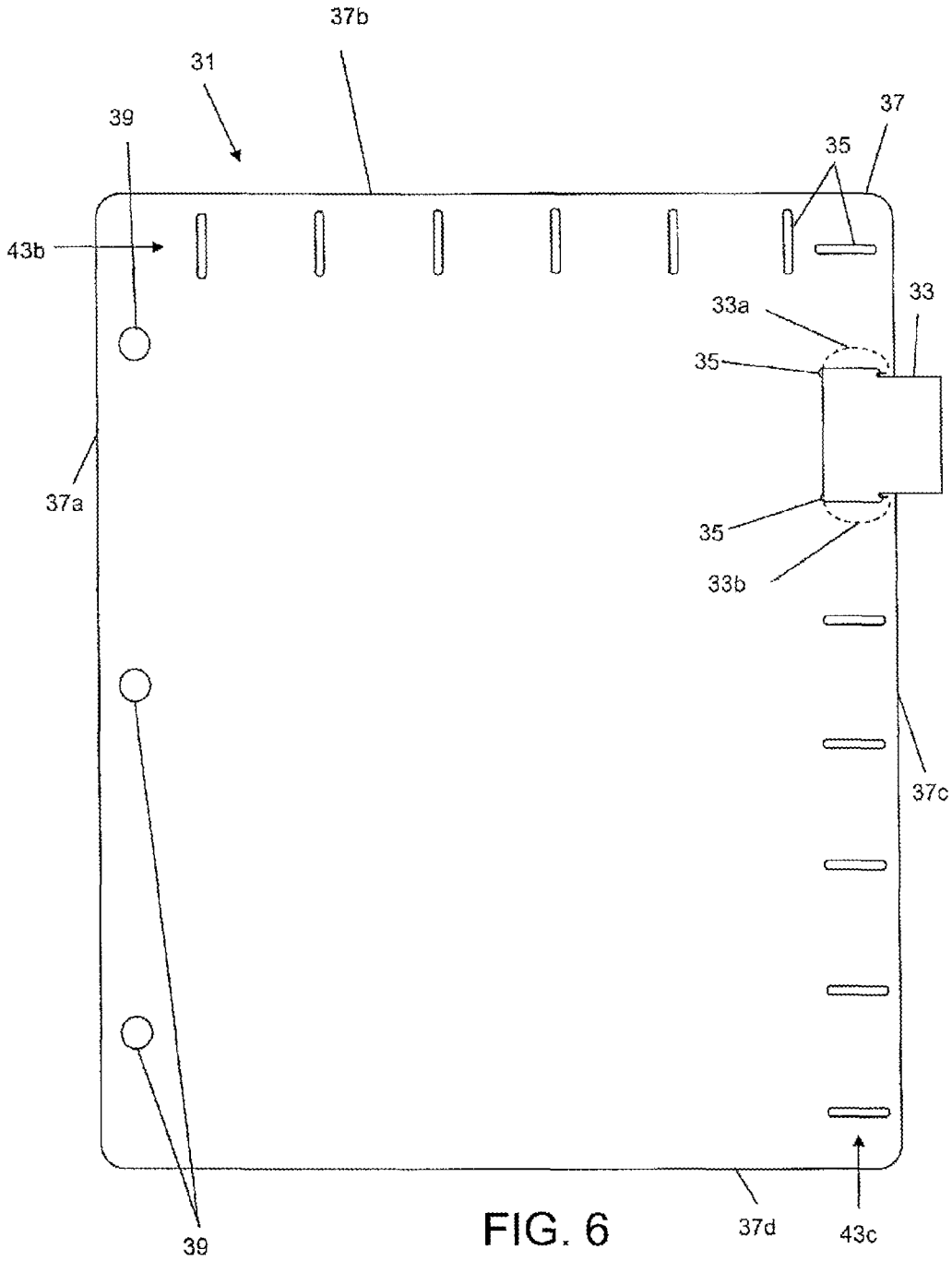
FIG. 6 shows a front view of the divider of FIG. 5 having the removable tab positioned along a right edge of the divider.

FIGS. 5-6 illustrate another embodiment of a divider having a repositionable tab. Like the embodiment described in connection with FIGS. 1-4, the divider may be used to divide sections of paper, such as loose leaf paper held by a binder. As shown in FIG. 5, the divider 31 includes a panel 37 and a tab 33. The panel 37 may be sized to approximate the size of loose leaf paper. For example, the divider may be approximately 8.5 inches wide and approximately 11 inches long. The panel 37 comprises a binding edge 37*a* and three non-binding or free edges 37*b*, 37*c* and 37*d*. Adjacent the binding edge 37*a*, the panel 37 comprises three holes 39, which are sized and positioned to each receive a ring of a three-ring binder. The holes 39, for example, may have a spacing of approximately 4.25 inches and may each have a diameter of approximately 0.25 inches.

The panel 37 comprises a plurality of rows of slots 35 along which the tab 33 is positionable. In the exemplary embodiment of FIGS. 5-7, the rows extend along two non-binding edges. In particular, row 43*b* extends along non-binding edge 37*b* and row 43*c* extends along non-binding edge 37*c*. Alternatively, however, the rows may extend along non-binding edges 37*c* and 37*d* or along non-binding edges 37*b*, 37*c* and 37*d*. The rows may comprise various numbers of slots 35 based, for example, on a desired number of slot pairs that may accommodate a tab and/or a desired width of the tabs. According to one example, the divider 31 comprises five slot pairs (six slots) along non-binding edge 37*b* and/or along non-binding edge 37*d* and eight slot pairs (nine slots) along non-binding edge 37*c*. According to another example, the divider 31 comprises four slot pairs (five slows) along non-binding edge 37*b* and/or along non-binding edge 37*d* and five slot pairs (six slots) along non-binding edge 37*c*.

The slots 35 may sized to accommodate ears 33*a* and 33*b* of the tab 33. For example, the slots 35 may have approximately the same height as the height of the ears 33*a* and 33*b*. The ears 33*a* and 33*b* may be inserted into adjacent slots 35. The ears 33*a* and 33*b* may include notches 45*a* and 45*b* to interface with the panel 37 adjacent the slots 35 and hold the tab 33 in place one inserted.

FIG. 5 illustrates the tab 33 positioned along non-binding edge 37*b*, and FIG. 6 illustrates the tab 33 repositioned along non-binding edge 37*c*. The size of the tab 33 and the location of the slots 35 relative to the edge of the panel 37 may be selected such that the tab extends beyond the edge when inserted into the slots.

Figure 7:
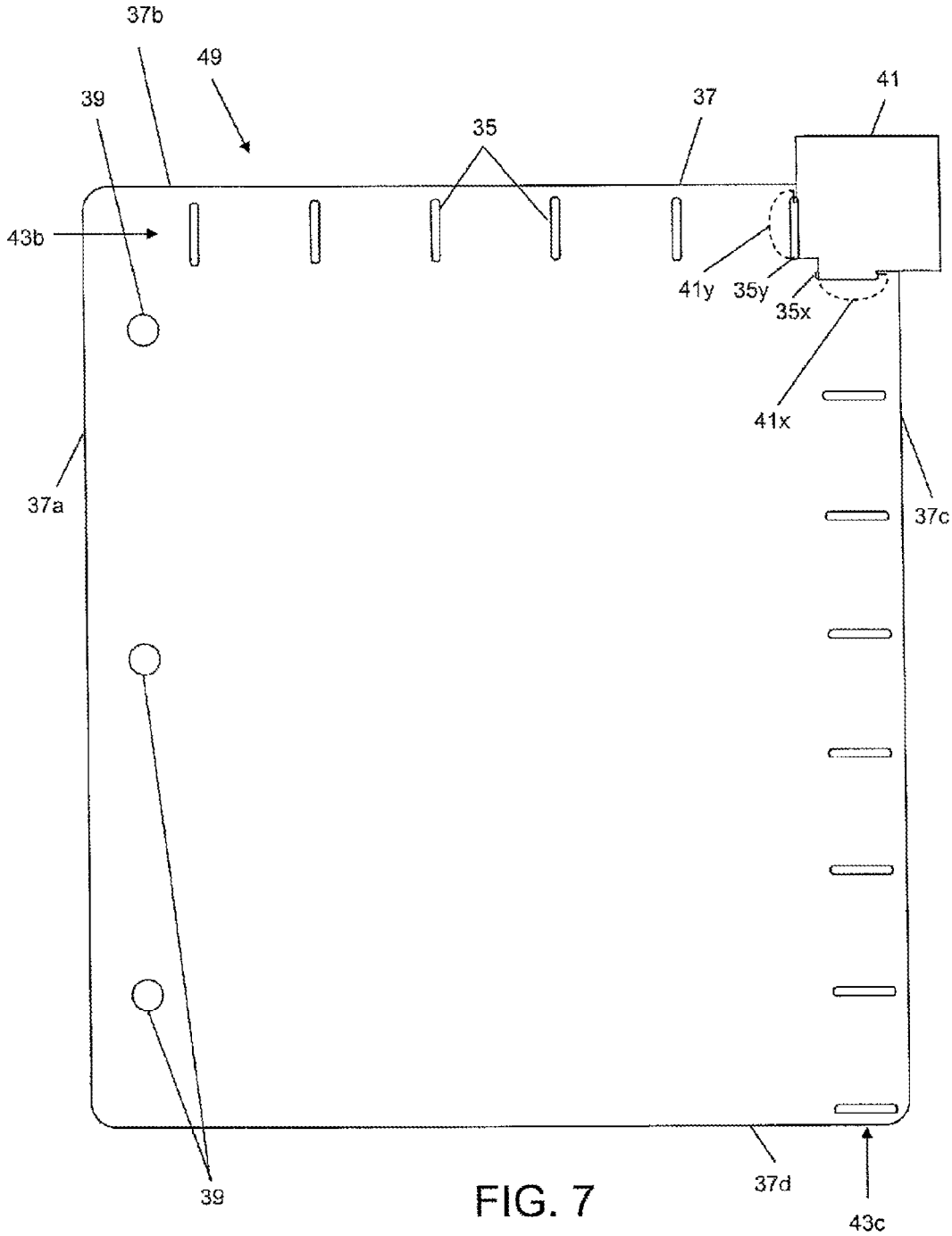
FIG. 7 shows a front view of a divider having a removable tab positioned at a corner of the divider.

FIG. 7 illustrates a further embodiment of a divider having a repositionable tab. The divider 49 of FIG. 7 is similar to the divider 31 of FIGS. 5 and 6, but includes slots 35 positioned to accommodate a corner tab 41. In particular, slot 35*x* is oriented along an x-axis, and slot 35*y* is oriented along a y-axis perpendicular to the x-axis. Similarly, tab 41 includes an ear 41*x* oriented along an x-axis, and an ear 41*y* oriented along a y-axis perpendicular to the x-axis. Slot 35*x* receives ear 41*x* of the tab 41, and slot 35*y* receives ear 41*y*. Alternatively or additionally, the tab 33 of FIGS. 5 and 6 may be positioned along the rows 43*a* and/or 43*b* of the divider 31.

The dividers described herein are not limited to use with three-ring binders. The dividers may alternatively be used in books, notebooks, portfolios, or other bound or non-bound items in which dividers may be useful. In the case of bound items, the binding means may comprise holes, adhesive, a spine, staples, a clamping mechanism, or other binding mechanisms. The dividers may be any suitable size, and may have a portrait or landscape configuration. That is, the top and bottom edges of a divider may be smaller or larger than its side edges.

Having described several illustrative embodiments of the invention, various alterations, modifications and improvements will readily occur to those skilled in the art. Such alterations, modifications and improvements are intended to be in the spirit and scope of the invention. Accordingly, the foregoing description is by way of example only and is not intended as limiting. The invention is limited only as defined in the following claims and the equivalence thereto.

What is claimed is:

1. A divider for use in a binder, the divider comprising:

a panel comprising a binding edge and a plurality of non-binding edges, wherein the panel comprises at least one binding feature adjacent the binding edge and at least one tab mating feature adjacent at least first and second non-binding edges of the plurality of non-binding edges; and a tab configured to mate with the at least one tab mating feature;

wherein the first and second non-binding edges are non-parallel;

wherein the at least one tab mating feature is configured such that the tab is positionable in at least two longitudinal positions along the first non-binding edge and in at least two longitudinal positions along the second non-binding edge; and wherein the tab extends at least partially beyond the first non-binding edge when the tab is positioned in the at least two longitudinal positions along the first non-binding edge, and extends at least partially beyond the second non-binding edge when the tab is positioned in the at least two longitudinal positions along second non-binding edge.

2. The divider of claim 1, wherein the at least one tab mating feature comprises a track, and the tab is configured to slide along the track.

3. The divider of claim 2, wherein the track comprises a slot and the tab comprises a slot mating feature that is configured to slide within the slot.

4. The divider of claim 3, wherein the slot mating feature comprises at least two disks.

5. The divider of claim 2, wherein the track comprises first track portion and a second track portion oriented perpendicular to the first track portion.

6. The divider of claim 5, wherein the track further comprises a corner track portion adjoining the first and second track portions such that the tab is slidable from the first track portion to the second track portion via the corner track portion.

7. The divider of claim 1, wherein the at least one tab mating feature comprises a plurality of tab attachment features spaced along the first and second non-binding edges.

8. The divider of claim 1, wherein the tab mating feature comprises a plurality of slots spaced along the first and second non-binding edges, wherein the spacing of the slots is related to dimensions of the tab.

9. A divider comprising:

a panel comprising at least one tab mating feature; and a tab configured to mate with the at least one tab mating feature;

wherein the at least one tab mating feature is configured such that the tab is positionable in at least two positions along a first axis adjacent a first edge and in at least two positions along a second axis adjacent a second edge and transverse to the first axis; and wherein the tab extends at least partially beyond the first edge when the tab is positioned in the at least two positions along the first axis, and extends at least partially beyond the second edge when the tab is positioned in the at least two positions along the second axis.

10. The divider of claim 9, wherein the tab mating feature comprises a track and the tab is configured to slide along the track.

11. The divider of claim 10, wherein the track comprises a first track portion oriented along the first axis and a second track portion oriented along the second axis.

12. The divider of claim 10, wherein the track further comprises a corner track portion adjoining the first and second track portions such that the tab is slidable from the first track portion to the second track portion via the corner track portion.

13. The divider of claim 9, wherein the at least one tab mating feature comprises a plurality of tab attachment features spaced along the first axis and the second axis.

14. The divider of claim 9, wherein the second axis is perpendicular to the first axis.

15. The divider of claim 9, wherein the divider comprises at least one binding feature to bind the divider to a stationary item.

16. A tabbed item comprising:

the divider of claim 9.

17. The tabbed item of claim 16, wherein the tabbed item comprises a notebook.

18. The tabbed item of claim 16, wherein the tabbed item comprises a portfolio.

19. The tabbed item of claim 16, wherein the tabbed item comprises a book.

20. The tabbed item of claim 16 wherein the tabbed item is bound.

* * * * *